United States Patent [19]

Chladil, Sr.

[11] 4,066,849

[45] Jan. 3, 1978

[54] ROTARY-TYPE CONTROL FOR HEADPHONE EARPIECE

[75] Inventor: Joseph J. Chladil, Sr., Milwaukee, Wis.

[73] Assignee: Koss Corporation, Milwaukee, Wis.

[21] Appl. No.: 694,973

[22] Filed: June 11, 1976

[51] Int. Cl.[2] ..... H04R 1/10; G05G 1/10

[52] U.S. Cl. ..... 179/178; 74/531; 74/553; 179/182 R

[58] Field of Search ..... 179/178, 182 R, 107 R; 74/10 R, 553, 531

[56] References Cited

U.S. PATENT DOCUMENTS

| | | | |
|---|---|---|---|
| 2,424,422 | 7/1947 | Tresise et al. | 179/107 R |
| 3,306,991 | 2/1961 | Wood | 179/107 R |

*Primary Examiner*—William C. Cooper
*Attorney, Agent, or Firm*—Quarles & Brady

[57] ABSTRACT

A rotary-type control for a headphone earpiece has an indexing dial which is loosely keyed to the control shaft of a potentiometer and extends partially through an opening in the cover of the earpiece to permit the wearer of the earpiece to manually control the potentiometer. The loosely keyed indexing dial is centered in the opening in the cover of the earpiece by the cooperative action of a journal bearing on the underside of the cover, a raised hub-like projection on the top of the indexing dial which is received and journaled in the bearing and a spring which exerts an upward force on the bottom of the dial keeping the hub-like projection journaled in the bearing so that the dial is level and centered in the opening in the cover.

12 Claims, 4 Drawing Figures

Fig. 1
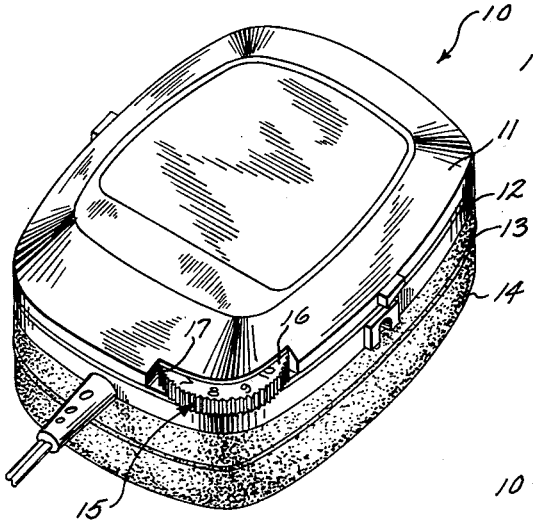
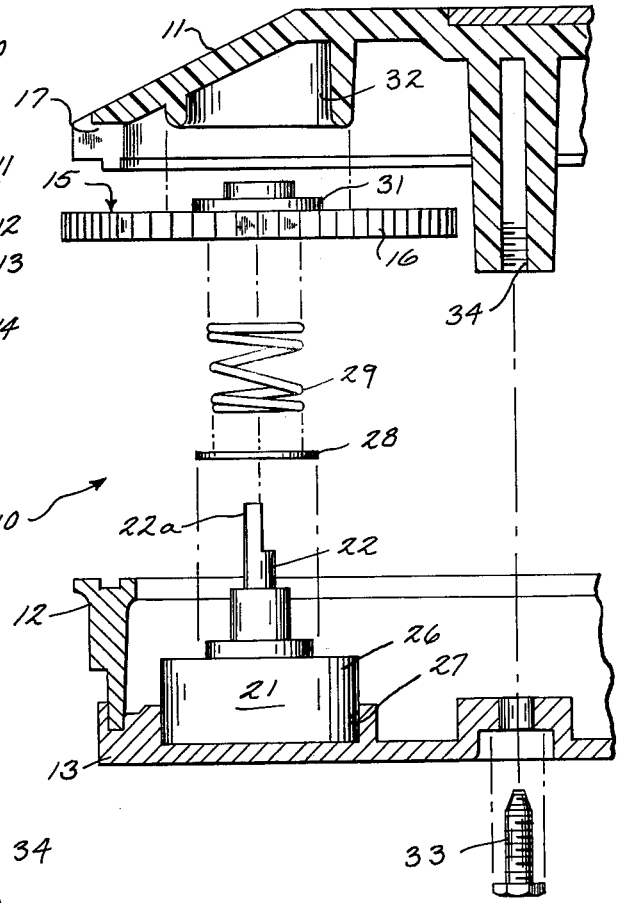
Fig. 3
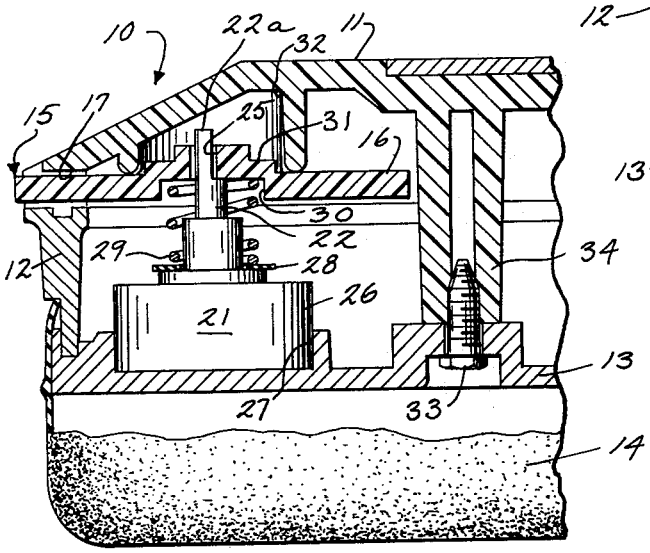
Fig. 4
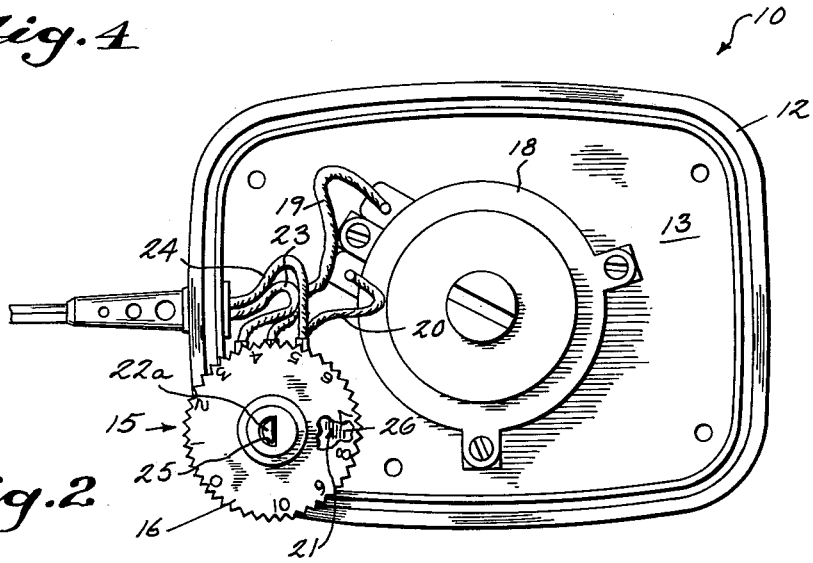
Fig. 2

ROTARY-TYPE CONTROL FOR HEADPHONE EARPIECE

BACKGROUND OF THE INVENTION

High quality headphones for reproducing stereophonically recorded programs often have earpieces which have individual volume-balance controls to allow the listener to make fine adjustments in both the volume level and the stereo balance without having to remove the earpieces or to adjust the receiver or the amplifier.

One type of control which has been employed in headphone earpieces is the conventional rotary-type control in which an indexing dial is friction fit directly to the control shaft of a potentiometer which controls the volume-balance output of an audiotransducer positioned in the earpiece. To permit manipulation of the control from outside the earpiece, a portion of the indexing dial extends through an opening in the cover of the earpiece.

The use of such conventional rotary-type controls for headphone earpieces has not been completely satisfactory because at times the indexing dial is not perfectly centered in the opening of the earpiece cover. When this occurs, the dial as it is rotated may contact the sides, top or bottom of the opening making fine adjustment difficult. The indexing dial may be imperfectly centered in the opening because the control shaft of the mass produced potentiometer is not perfectly perpendicular to the body of the potentiometer. Another reason this may occur is that although the control shaft is perpendicular to the body of the potentiometer, the potentiometer itself may be imperfectly positioned in the base of the earpiece and as a result the indexing dial which is friction fit tightly to the shaft may be canted so that it is not centered in the opening in the cover.

SUMMARY OF THE INVENTION

It is the general object of the present invention to disclose an improved rotary-type control for an earpiece of a stereophonic headphone or the like in which the indexing dial is properly centered in the opening in the cover of the earpiece to that the dial can be easily manipulated to make fine adjustments.

It is a further object of the invention to disclose an improved rotary-type control for use with earpieces of headphones which employ control potentiometers or the like, which rotary-type control prevents minor irregularities in the orientation of the control shaft of the potentiometer from interfering with the proper alignment of the indexing dial in the opening of the earpiece cover.

The present invention relates to a rotary-type control for a headphone earpiece which has an indexing dial which is loosely keyed to the control shaft of a potentiometer and extends partially through an opening in the cover of the earpiece to permit the wearer of the earpiece to manually control the potentiometer. The loosely keyed indexing dial is centered in the opening in the cover of the earpiece by the cooperative action of a journal bearing on the underside of the cover, a raised hub-like projection on the top of the indexing dial which is received and journaled in the bearing and a spring which exerts an upward force on the bottom of the dial keeping the hublike projection journaled in the bearing so that the dial is level and centered in the opening in the cover.

A more specific object of this invention is to provide the improved rotary-type control to be described hereafter.

The foregoing and other objects and advantages of the invention will appear from the following description. In the description reference is made to the accompanying drawings which form a part thereof, and in which there is shown by way of illustration a preferred embodiment of the invention.

BRIEF DESCRIPTION OF THE DRAWINGS

FIG. 1 is a perspective view of an earpiece of a headphone employing the rotary-type control of the present invention;

FIG. 2 is a top view of the earpiece of FIG. 1 with the cover removed;

FIG. 3 is an exploded side view partially in section showing the unassembled components of the improved rotary-type control; and FIG. 4 is a side view partially in section taken along lines 4—4 of FIG. 2, but with the cover in place.

DESCRIPTION OF THE PREFERRED EMBODIMENT

In FIG. 1 there can be seen a completely assembled headphone earpiece 10 which has a cover 11, an intermediate body section 12 and a base 13. Overlying the base 13 is a fluid-filled ear cushion 14 which provides a comfortable fit for the listener's ear. As can also be seen in FIG. 1, the earpiece if provided with a rotary-type control 15 of which only a portion of the indexing dial 16 can be seen extending through an opening 17 in the cover 11 of the earpiece 10.

Turning now to FIG. 2 in which the cover 11 has been removed from the earpiece 10, it can be seen that an audiotransducer 18 is positioned in the base 13 of the earpiece to direct sound to central openings (not seen) in the base 13 and the ear cushion 14 and into the ear of the listener. The audiotransducer 18 is connected by wires 19, 20 to a control potentiometer 21 of which only the top of the control shaft **22*a* can be seen in FIG. 2. The potentiometer 21 is connected by wires 23, 24 to an amplifier or a stereo receiver (not shown). The view of the control potentiometer 21 in FIG. 2 is blocked by the indexing dial 16 which is seen to be provided with indexing numbers and a knurled periphery. As seen in FIG. 2, the dial has a central aperture 25 which is positioned about and loosely keyed to the control shaft 22*a* of the potentiometer 21**.

In FIG. 3, the components of the rotary-type control are shown in unassembled but properly orientated position and in FIG. 4 the components are shown in completely assembled condition.

Turning now to FIG. 3, it can be seen that the control potentiometer 21 has a main body 26 which is positioned in a recess 27 in the base 13 of the earpiece 10. The control shaft 22 of the potentiometer 21 extends substantially perpendicular to the base 13 of the earpiece 10 and the main body 26 of the potentiometer 21. The base of the control shaft 22 adjacent a body of the potentiometer is clyindrical in shape but the outermost portion of the shaft **22*a*** is semicylindrical in shape and semicircular in cross-section as seen in FIG. 2.

Turning now to FIG. 4, it can be seen that a washer 28 is positioned axially about the control shaft 22 and an upper portion of the body 26 of the potentiometer 21 which houses the base of the shaft 22. Overlying the washer 28 is a compression spring 29 which is positioned axially about the control shaft so that the bottom of the compression spring 29 rests upon and is supported by the top of the washer 28. The top of the spring 29 is received in a circular recess 30 in the bottom of the indexing dial 16. In FIG. 4 it can also be seen that the top of the dial 16 is provided with a hub-like stepped cylindrical projection 31 which is coaxial with the central aperture 25 as is the circular recess 30.

When the earpiece 10 is completely assembled as seen in FIG. 4, the hub-like cylindrical projection 31 is positioned in the central opening of an annular projection or journal bearing 32 which extends downwardly from the underside of the cover 11 of the earpiece 10. The mouth of the journal bearing 32 extends slightly below the top of the opening 17 in the cover 11 of the earpiece 10. As seen in FIG. 4, the upward force exerted by the compression spring 29 on the bottom of the indexing dial 16 maintains the dial 16 in a position in which the hub-like projection 31 is journaled in the bearing 32 and main body portion of the dial 16 is leveled so that it is centered within the opening 17 by the open mouth of the journal bearing 32.

When the components are assembled as illustrated in FIG. 4, the earpiece cover 11 is secured to the intermediate body 12 and base 13 by use of the screws 33 (only one of which is shown) which extend through an opening in the base 13 and engage the screw receiving portion 34 on the underside of the cover 11 to form a unitary earpiece housing. The assembly of the earpiece is then completed by slipping or stretch fitting the lip of the cushion 14 over the bottom edge of the base 13.

As previously pointed out, the indexing dial 16 of the disclosed improved rotary-type control 15 is only loosely keyed to the control shaft 22 as seen in FIGS. 2 and 4. Therefore, the minor variations in the orientation of the control shaft 22 that would normally prevent the dial 16 from being centered in the opening 17 in the cover 11 if the dial 16 was friction fit to the control shaft 22, have no detrimental effects on the positioning of the dial 16 in the opening 17. The dial 16 is not dependent upon the perfect orientation of the potentiometer or its shaft because it is centered in the opening 17 by the cooperative action of the spring 29, the hub-like projection 31 and the journal bearing 32.

Although the invention has been particularly described in connection with the use of stereophonic headphone earpieces, it will be understood that there may be other embodiments or applications in which the improved rotary-type control which is inexpensive, dependable and durable may be employed.

It will be readily apparent to those skilled in the art that a number of modifications and changes may be made without departing from the spirit and scope of the invention as described. For example, in some applications it may be preferred to dispense with the hub-like projection and have the end of the control shaft extend above the surface of the dial to serve as the journal. In other applications it may be preferred to provide the dial with a recess to serve as a journal bearing and to provide the cover with a journal member. It will also be apparent that different shapes of covers, bases, dials, apertures and shafts may be employed if desired, as long as they function in the manner described. Therefore, it is not intended that the invention be limited by the showing herein or in any other manner, except insofar as may specifically be required.

I claim:

1. A rotary-type control for a headphone earpiece having an opening therein, the combination comprising:

a. a potentiometer mounted within the earpiece and having a rotatable shaft;

b. an indexing dial loosely keyed to the shaft, said dial having a portion which extends through the opening in the earpiece so that it can be manually manipulated from the outside of the earpiece;

c. a bearing formed on the interior of the earpiece and positioned to engage said dial and level and center it in the earpiece opening; and d. a spring which maintains said dial in contact with the bearing as the shaft is rotated.

2. The control of claim 1 in which the dial has a central aperture which is loosely keyed to the control shaft which extends through said aperture.

3. The control of claim 2 in which the central aperture in the dial is the same shape but larger than the cross-sectional area of the control shaft to which it is loosely keyed.

4. The control of claim 1 in which a journal is formed on the dial and said bearing is a journal bearing which cooperates with said journal.

5. The control of claim 4 in which the journal is a hub-like projection on the dial.

6. The control of claim 1 in which the spring is a compression spring which is positioned about the control shaft of the potentiometer between the main body of the potentiometer and the indexing dial.

7. The control of claim 6 in which the compression spring is received in a circular recess formed on the indexing dial.

8. In an apparatus having a base containing a device having a shaft which can be rotated to control the device, shaft rotating means, and a cover for said apparatus which cover has an opening to expose a portion of the shaft rotating means so that it can be manually manipulated to control the shaft, the improvement which comprises:

a. shaft rotating means loosely keyed to the control shaft;

b. a journal and a journal bearing associated with the shaft rotating means and the cover which cooperate to level and center the shaft rotating means in the opening in the cover; and c. a spring which maintains the journal and journal bearing in cooperative relationship to level and center the shaft rotating means in the opening in the cover.

9. The apparatus of claim 8 in which the shaft rotating means is provided with an aperture which is loosely keyed to the control shaft which extends through said aperture.

10. The apparatus of claim 8 in which the shaft rotating means is a circular indexing dial.

11. The apparatus of claim 8 in which the journal is on the shaft rotating means and the journal bearing is on the underside of the cover.

12. A rotary-type control for a headphone earpiece, the combination comprising:

an enclosure having a cover portion and a base portion which are spaced apart to form a cavity therebetween, said enclosure having an opening therein which communicates with said cavity;

a potentiometer disposed within said cavity and having a body which is mounted to said base portion and a shaft which extends toward said cover portion;

a dial mounted to said shaft and loosely keyed thereto, said dial extending radially outward from the axis of rotation defined by the potentiometer shaft and a portion thereof extending through the opening in the enclosure;

a bearing surface formed on said cover and disposed within said cavity, said bearing surface defining a plane which is substantially perpendicular to the axis of rotation of said potentiometer shaft and which is precisely aligned with respect to the opening in said enclosure; and a spring disposed around said potentiometer shaft and between said potentiometer body and said dial, said spring generating an axially directed bias force which retains said dial against said bearing surface and hence in alignment with said opening.

* * * * *